US012414621B2

(12) United States Patent
Hassig

(10) Patent No.: US 12,414,621 B2
(45) Date of Patent: Sep. 16, 2025

(54) QUICK ATTACH BACKPLATE

(71) Applicant: Matthew William Hassig, Binghamton, NY (US)

(72) Inventor: Matthew William Hassig, Binghamton, NY (US)

( * ) Notice: Subject to any disclaimer, the term of this patent is extended or adjusted under 35 U.S.C. 154(b) by 0 days.

(21) Appl. No.: 18/907,232

(22) Filed: Oct. 4, 2024

(65) Prior Publication Data

US 2025/0134239 A1 May 1, 2025

Related U.S. Application Data

(60) Provisional application No. 63/593,107, filed on Oct. 25, 2023.

(51) Int. Cl.
*A45F 3/08* (2006.01)
*A45F 3/04* (2006.01)

(52) U.S. Cl.
CPC ..... *A45F 3/08* (2013.01)

(58) Field of Classification Search
CPC ..... A45F 3/08; A45F 3/04
USPC ..... 224/628
See application file for complete search history.

(56) References Cited

U.S. PATENT DOCUMENTS 5,014,892 A * 5/1991 Copeland ..... A45F 5/02 224/678
5,131,576 A * 7/1992 Turnipseed ..... A45F 3/08 224/907
5,201,858 A * 4/1993 Otrusina ..... A45F 5/02 24/3.1
5,274,885 A * 1/1994 Hellweg ..... A45F 5/02 24/3.12
5,604,958 A * 2/1997 Anscher ..... A45C 7/0086 24/165
5,620,120 A * 4/1997 Tien ..... H04M 1/04 224/904

(Continued)

FOREIGN PATENT DOCUMENTS

EP 3622849 A1 3/2020
WO 2000008971 A1 2/2000
WO 2012081013 A1 6/2012

OTHER PUBLICATIONS

Badlands, Swap: Get Ready To Customize, Retrieved From Internet, Retrieved On Oct. 4, 2024, <URL: https://www.badlandsgear.com/pages/swap-system>.

*Primary Examiner* — Nathan J Newhouse
*Assistant Examiner* — Lester L Vanterpool

(57) ABSTRACT

An attachment fastening system designed to enable quick attachment of different objects or accessories to a base plate. The system can be modified for use in multiple applications such as a modular backpack to be used for carrying various objects and accessories. The system can also be used to secure other external objects directly to the base as well. The system comprises a base and an attachment mechanism. The attachment mechanism has a modular design that can be used to easily swap out various objects or accessories from the base without the need for additional fastening tools. The 10 attachment mechanism comprises a base receiver and an attachment adapter, wherein the base receiver attaches and interlocks with the attachment adapter. Once locked in place, the attachment adapter becomes operably coupled to the base receiver and the object or accessory is safely secured to the base.

16 Claims, 9 Drawing Sheets

(56) References Cited

U.S. PATENT DOCUMENTS 5,622,296 A * 4/1997 Pirhonen ..... A45F 5/02 248/225.11
5,730,342 A * 3/1998 Tien ..... H04M 1/04 24/3.12
5,850,996 A * 12/1998 Liang ..... H04M 1/04 248/221.11
5,954,253 A * 9/1999 Swetish ..... A45F 3/08 224/628
6,006,969 A * 12/1999 Kim ..... A45F 5/021 224/272
6,079,602 A * 6/2000 Howell ..... A45F 3/047 224/637
6,161,741 A * 12/2000 French ..... F41C 33/0227 224/198
6,283,348 B1 * 9/2001 Wang ..... G08B 3/1058 24/3.12
6,481,684 B1 * 11/2002 Farmer ..... H04B 1/385 248/225.11
6,736,136 B2 * 5/2004 Chen-Lieh ..... B63C 11/205 24/3.11
7,032,791 B2 * 4/2006 Stotts ..... A45F 5/02 224/269
7,506,419 B2 * 3/2009 Kung ..... A44B 11/258 24/656
7,594,569 B2 9/2009 Bass et al.
8,353,433 B2 * 1/2013 Wrigley ..... A62B 25/00 224/633
8,622,268 B2 * 1/2014 Townsend ..... A62B 25/00 224/633
8,919,622 B1 * 12/2014 Gabriel ..... A45F 5/021 224/159
9,101,198 B2 * 8/2015 Tseng ..... A45F 5/02
9,232,848 B2 * 1/2016 Krikorian ..... A45F 3/08
10,712,127 B2 * 7/2020 Tedder ..... A45F 5/021
11,399,620 B2 * 8/2022 Shtriker ..... A45F 3/14
2004/0082238 A1 * 4/2004 Jacoway ..... B63C 11/02 405/187
2008/0209698 A1 * 9/2008 Colorado ..... A45F 5/021 24/595.1
2009/0071990 A1 * 3/2009 Jardine ..... A45F 3/10 224/155
2011/0048421 A1 * 3/2011 Carr ..... B63C 11/02 224/633
2013/0232742 A1 * 9/2013 Burnett ..... A45F 3/14 24/606
2015/0233669 A1 * 8/2015 Ponder ..... F41C 33/001 224/271

* cited by examiner

QUICK ATTACH BACKPLATE

FIELD OF THE INVENTION

The present invention relates generally to mechanical interfaces and attachment mechanisms. More specifically, the present invention discloses a mechanical interface that allows the user to easily swap out different attachments.

BACKGROUND OF THE INVENTION

Nowadays, different equipment is designed to accommodate different attachments or accessories. For example, various backpacks are now designed to accommodate external objects so that the external objects can be carried on the backpack. Similarly, other mechanical interfaces have been made available that help external objects to be attached to an object or surface. For example, hook and loop fastener pads have been made available to help attach different objects to the selected surface. Similarly, mechanical interfaces have been made available that allow for a more secure attachment of the external objects to the desired surface or body. However, the existing mechanical interfaces can be difficult to use which prevents the user from quickly swapping attachments. Thus, there is a need for a better mechanical interface that allows for quick swapping of attachments.

An objective of the present invention is to provide a quick attach interface that allows for different attachments to be safely secured to a common interface for ease of storage and transportation. The present invention includes an attachment mechanism that creates a strong mechanical connection between two specially designed parts. Another objective of the present invention is to provide a quick attach interface that includes a base that can be a back-worn frame/plate. The attachment mechanism can include a base receiver that is integrated onto the base. The base receiver can be locking or non-locking, depending on user preference. Further, the different attachments can be extremely variable and can include, but are not limited to, a soft-shell backpack, a sunshade, etc. Furthermore, the present invention can be implemented into different applications such as in off-road vehicles or marine applications. The present invention can also be implemented in residential and commercial applications that require secure and removable attachment of devices to a permanent base.

SUMMARY OF THE INVENTION

The present invention is an attachment fastening system designed to enable quick attachment of different objects or accessories to a base plate. The present invention can be modified for use in multiple applications. For example, the present invention can be implemented as a modular backpack that allows for different objects and accessories to be carried together in the same manner as a traditional backpack. The attachment fastening system can also be used to secure other external objects as well.

To perform this functionality, the attachment fastening system comprises a base and an attachment mechanism. The base is an elongated support structure of any size or shape that can accommodate the attachment mechanism. The attachment mechanism has a modular design that can be used to easily swap out various objects or accessories from the base without the need for additional fastening tools. The attachment mechanism comprises a base receiver and an attachment adapter. The base receiver mounts to the backside of the base, while the other side of the base receiver attaches and interlocks with the attachment adapter. The attachment adapter is a device designed to retrofit any object or accessory in a way that enables said object or accessory to detachably connect to the base receiver.

To engage the attachment mechanism, the user first aligns each of the connectors on the attachment adapter with the corresponding receiver openings on the base receiver. Once aligned, the user then inserts the connectors into the receiver openings, thereby joining the attachment adapter to the base receiver in an unlocked position. To lock the connectors in place, the user slides the connectors vertically along a slotted path integrated into the base receiver. Once locked in place, the attachment adapter is now operably coupled to the base receiver and the object or accessory is safely secured to the base.

In the preferred embodiment, the present invention further comprises a spring-loaded lock integrated into the base receiver. When activated, the spring-loaded lock holds the attachment adapter to the base receiver in the locked position. When deactivated, the spring-loaded lock quickly releases the attachment adapter from the locked position, allowing the user to detach the attachment adapter from the base receiver.

The spring-loaded lock utilizes a slide latch mounted within a cavity of the base receiver. When activated, the slide latch blocks the pathway of one of the connectors, which in turn, prevents the connector from aligning with the receiver opening. This misalignment keeps the connector in the locked position until the spring-loaded lock is disengaged.

DETAIL DESCRIPTIONS OF THE INVENTION

All illustrations of the drawings are for the purpose of describing selected versions of the present invention and are not intended to limit the scope of the present invention.

Hereinafter, the term "front face" refers to the forward-most surface of any given component of the present invention (i.e., nearest the user/structure carrying the base). Conversely, the term "rear face" refers to the aft-most surface of any given component of the present invention (i.e., nearest the attachment).

In reference to FIGS. 1-11, the present invention is a quick attach interface, hereinafter referred to as an attachment fastening system 1. The attachment fastening system 1 is designed to enable quick attachment of different objects or accessories to a base 2. The present invention can be modified to be utilized in different applications. For example, the present invention can be implemented as a modular backpack that allows for different objects and accessories to be carried together in the same manner as a traditional backpack. The present invention can also be used to secure other external objects as well.

Figure 1:
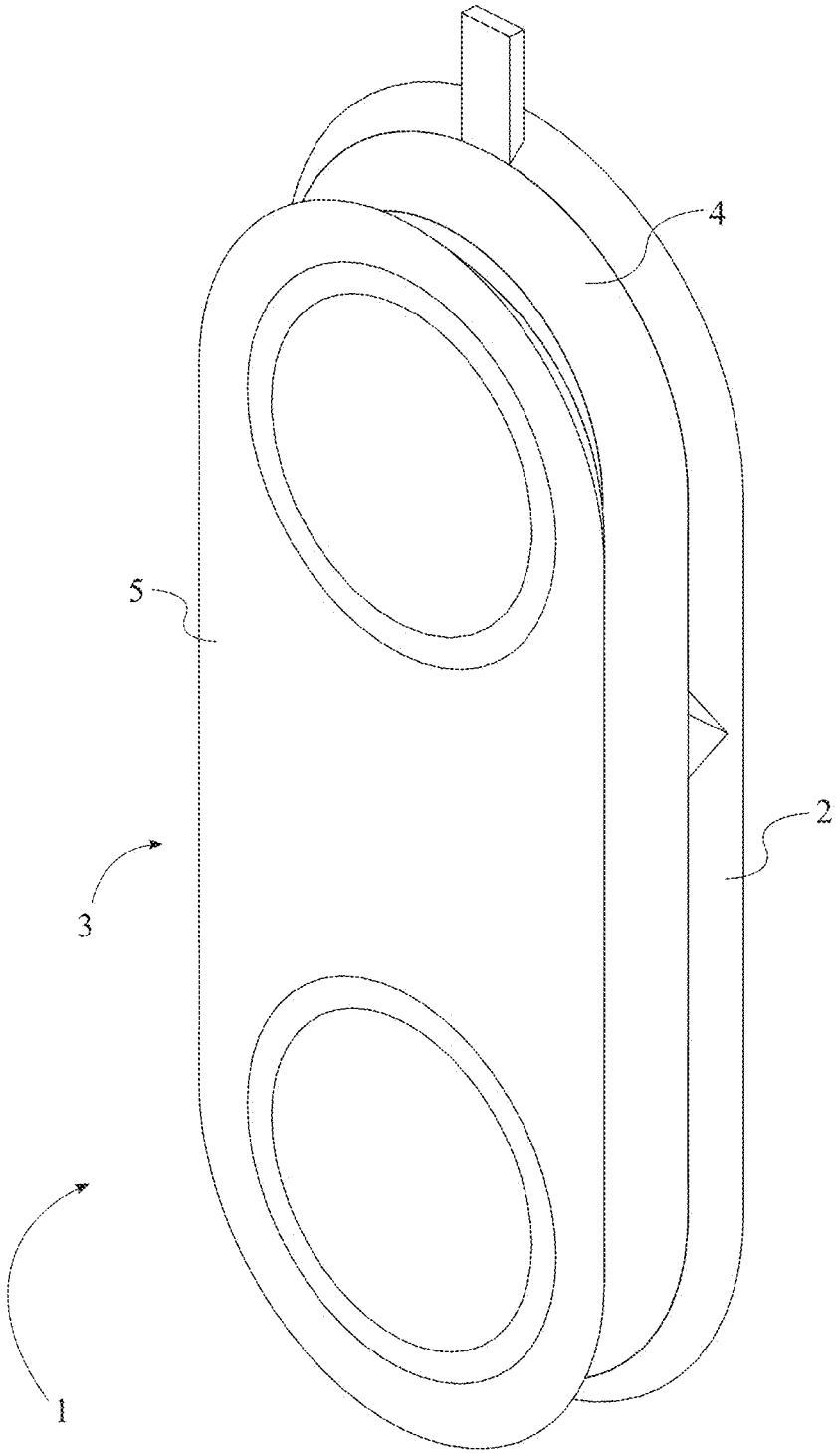
FIG. 1 is a top-rear perspective view of the present invention.
Figure 2:
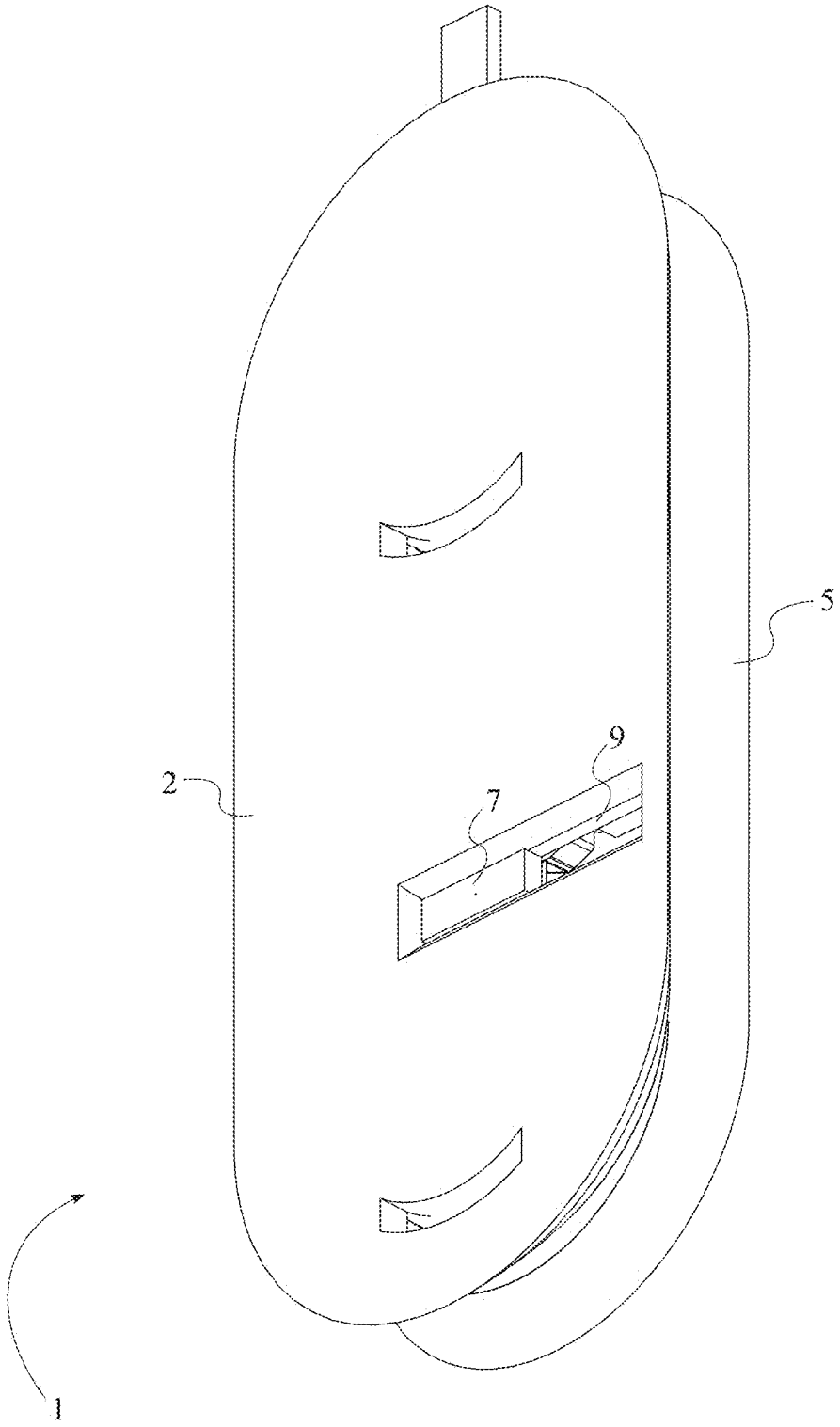
FIG. 2 is a bottom-front perspective view of the present invention.
Figure 3:
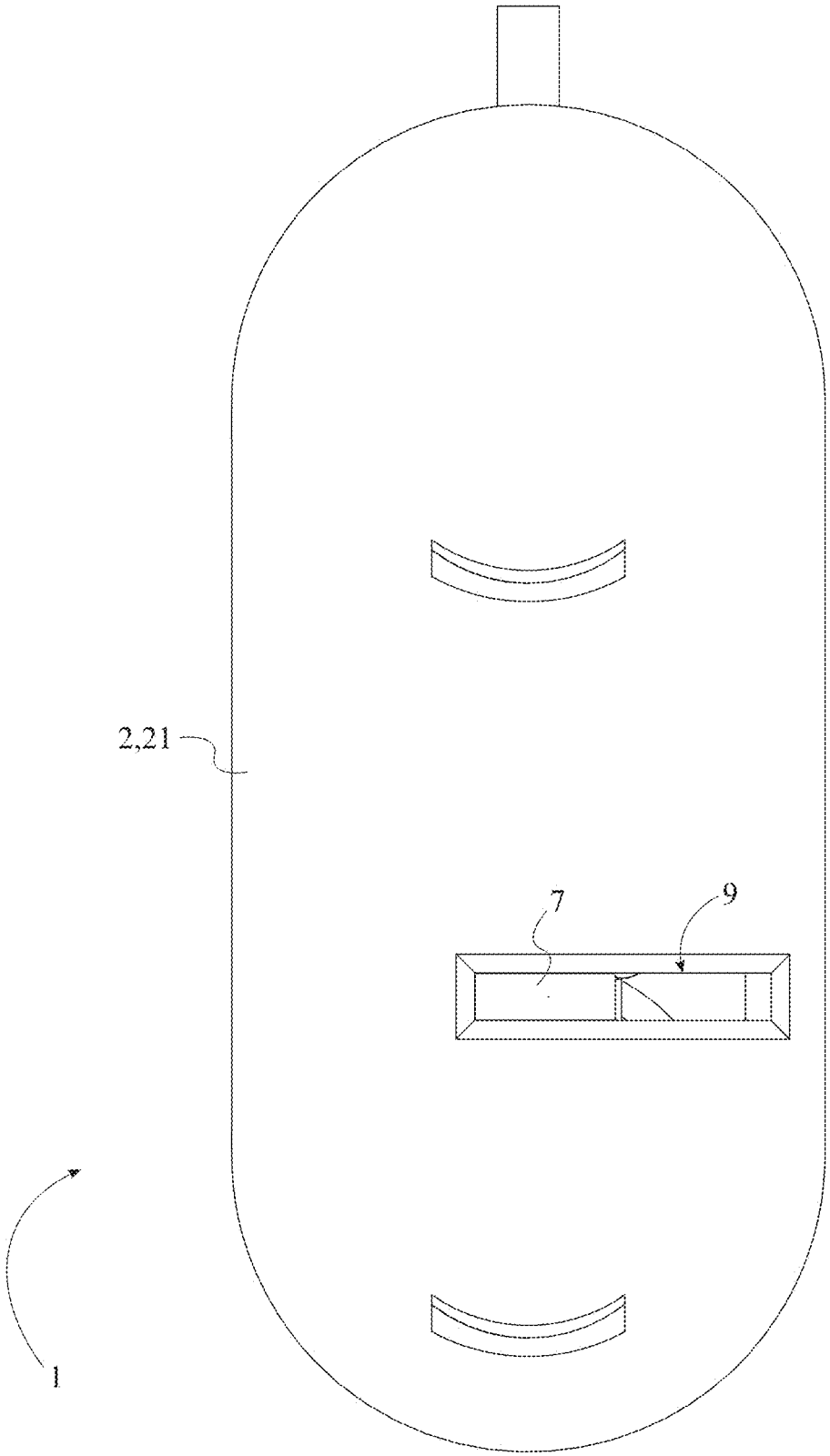
FIG. 3 is a front elevational view of the present invention.

As can be seen in FIGS. 1-3, the attachment fastening system 1 comprises a base 2 and an attachment mechanism 3. The base 2 is a support structure that accommodates the attachment mechanism 3 as well as any attachment secured to the base 2. With this arrangement, the user can carry various types of attachments mounted to the base 2 via the attachment mechanism 3. The attachment mechanism 3 has a modular design, allowing the user to easily swap different types of objects or accessories from a common supporting base 2. The base 2 can be any flat, elongated structure with a shape and size that meets the requirements set by the desired application.

Figure 10:
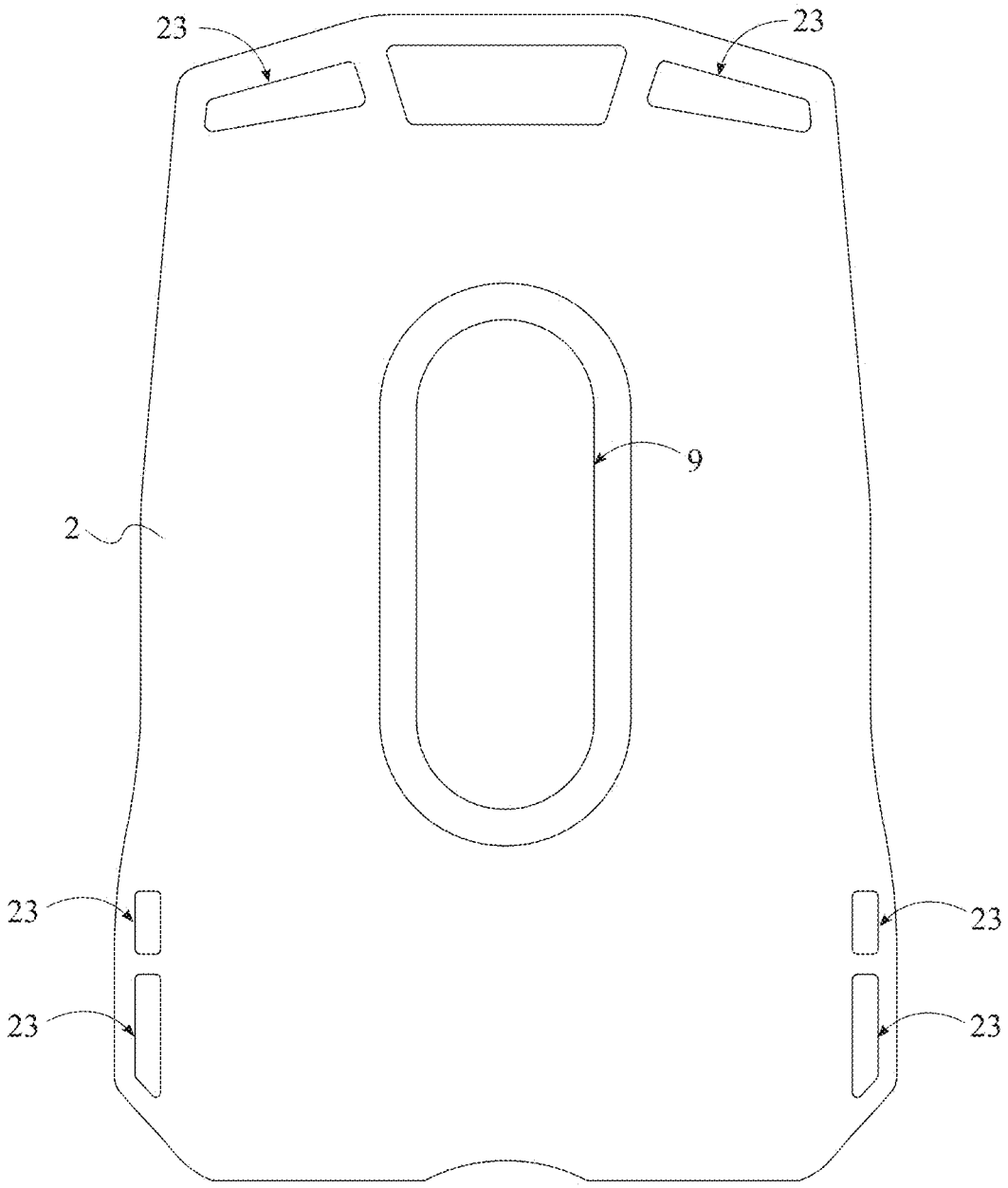
FIG. 10 is a front elevational view of an alternative embodiment of the base of the present invention.
Figure 11:
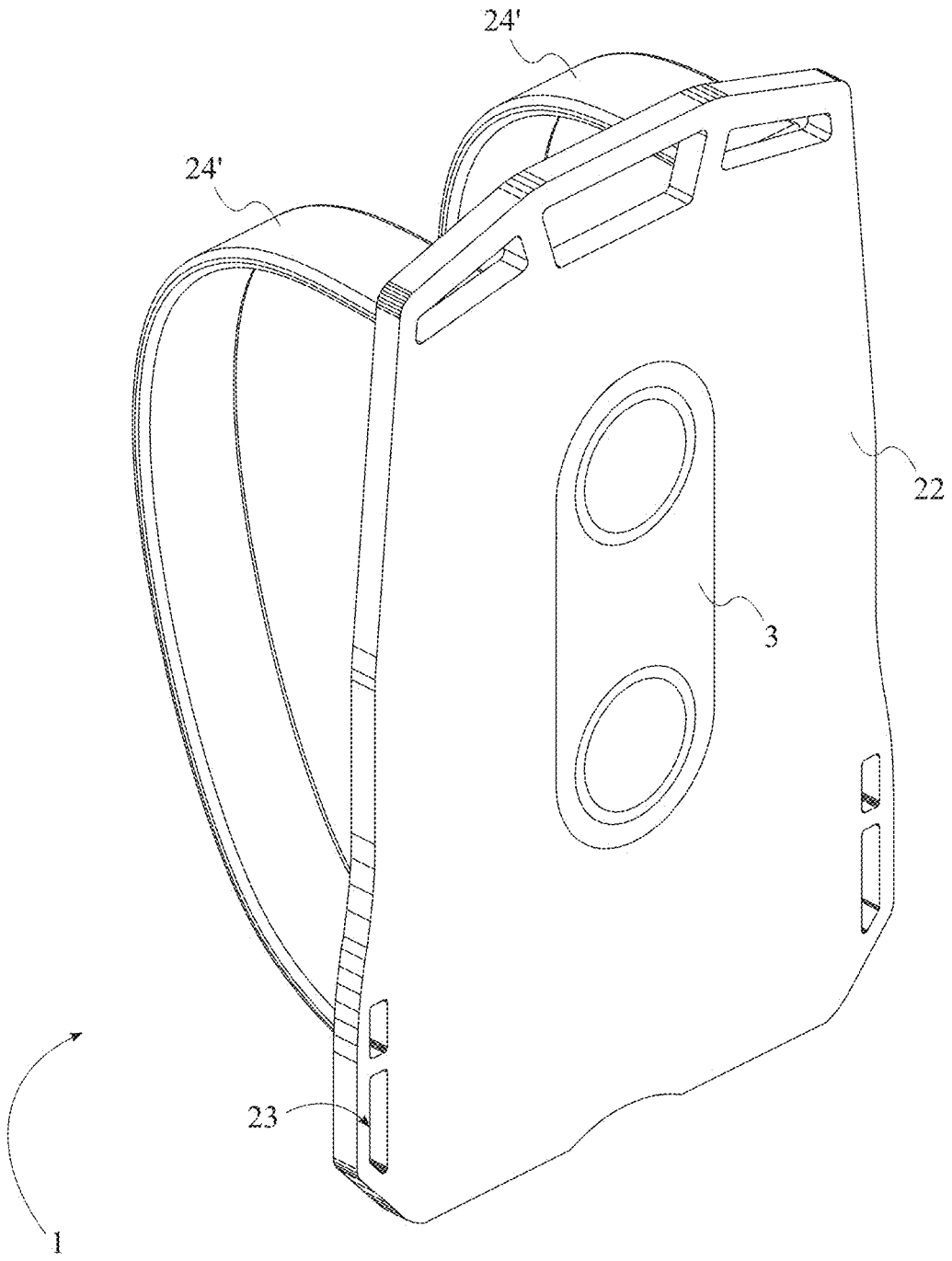
FIG. 11 is a top-front perspective view of an alternative embodiment of the present invention.

In a preferred embodiment, as seen in FIG. 10, the base 2 may further comprise a plurality of openings 23. The plurality of openings 23 can be used to attach various objects to the base 2 via one or more fastening devices 24 (e.g., buckle strap, keychain, clasp hook), all of which function independently of the attachment mechanism 3. In other words, the user can remove and detach the attachment mechanism 3 from the base 2 without having to remove any of the fastening devices 24 from the plurality of openings 23. In one embodiment, as seen in FIG. 11, the fastening device 24 is a plurality of straps 24' arranged to form at least one closed loop. In this embodiment, the straps allow the user to carry the base 2 as a backpack, along with any other accessories attached to the base 2 via the attachment mechanism 3.

Figure 4:
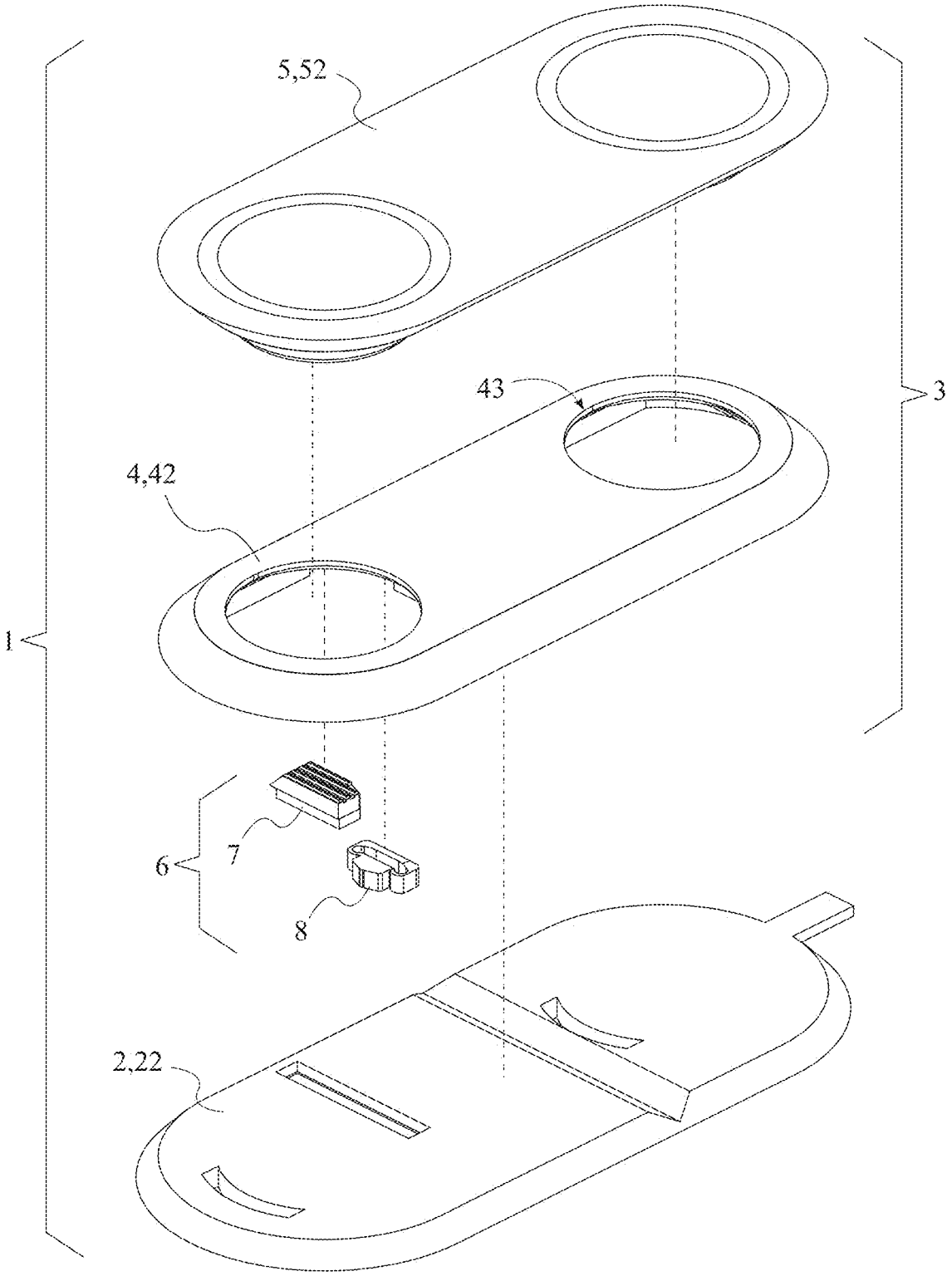
FIG. 4 is a top perspective exploded view of the present invention.
Figure 5:
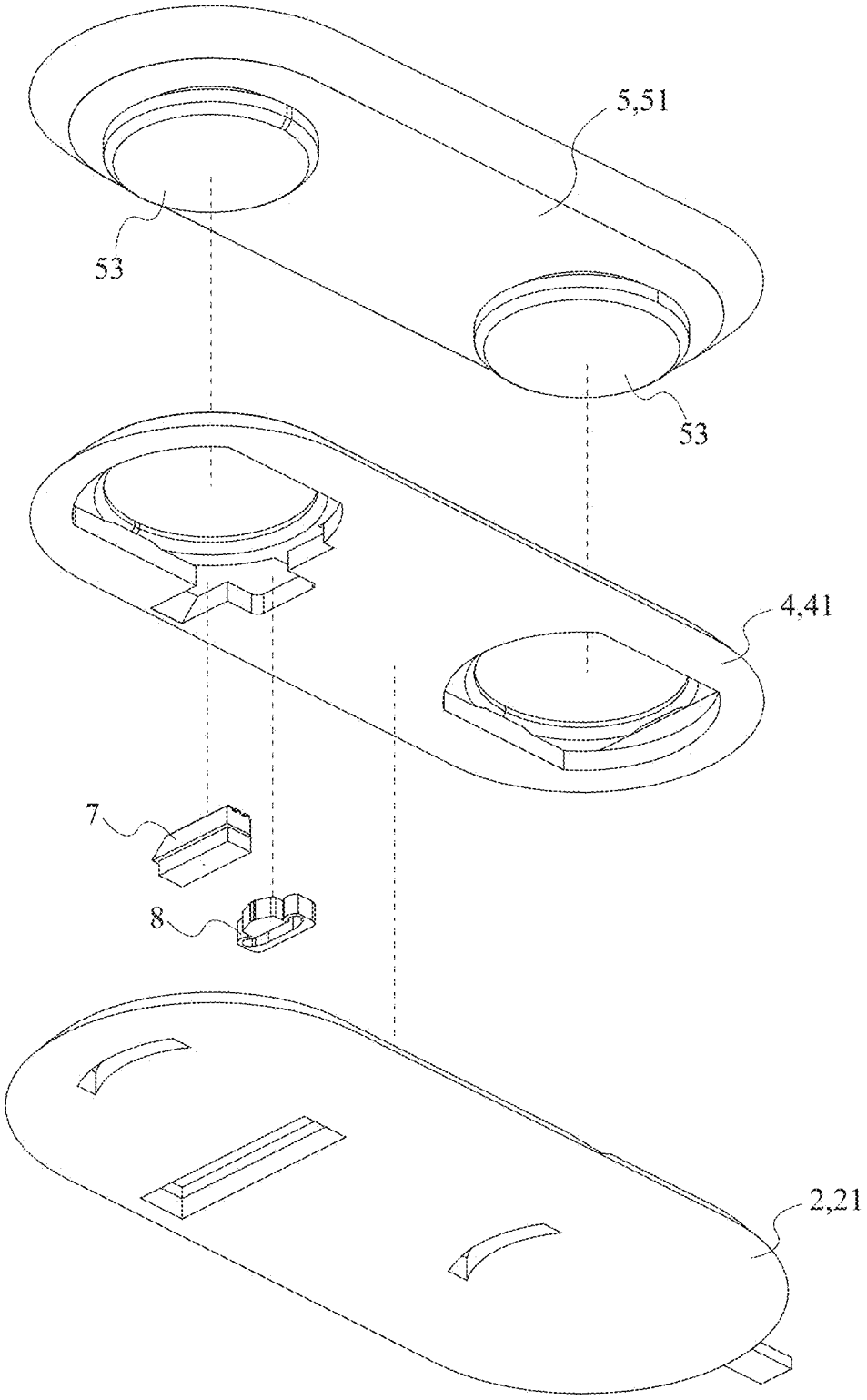
FIG. 5 is a bottom perspective exploded view of the present invention.

The attachment mechanism 3 is designed to enable the quick attachment and detachment of select accessories without the need for additional fastening tools. As best seen in FIG. 4 and FIG. 5, the attachment mechanism 3 comprises a base receiver 4 and an attachment adapter 5. The base 2 is connected to the base receiver 4. More specifically, the front face 41 of the base receiver 4 is attached to the rear face 22 of the base 2 using any means of attachment known in the art, including but not limited to adhesive bonding, threaded fasteners, or quarter turn latches. The base receiver 4 is designed to hold and secure any attachment to the base 2 via the attachment adapter 5. The attachment adapter 5 is designed to retrofit any object or accessory in a way that enables said object or accessory to detachably connect to the base receiver 4. Specifically, the object or accessory connects to or integrates with the rear face 52 of the attachment adapter 5, while the front face 51 of the attachment adapter 5 is configured to detachably connect with the base receiver 4. This arrangement allows the user to swap any attachment with another attachment that is also equipped with an attachment adapter 5. Alternatively, the user can remove the attachment adapter 5 from the unwanted attachment and equip the desired attachment with said attachment adapter 5.

Figure 6:
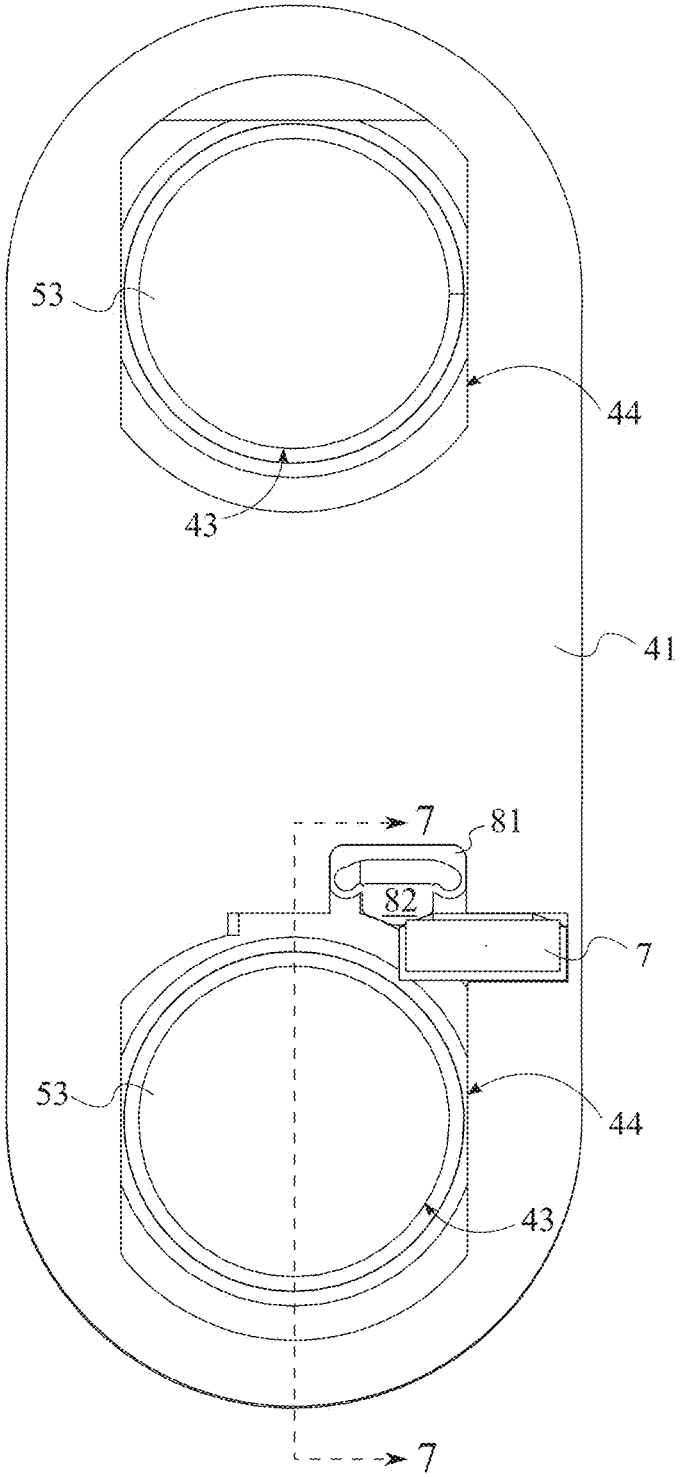
FIG. 6 is a front elevational view of the attachment mechanism of the present invention, shown in an unlocked position.
Figure 7:
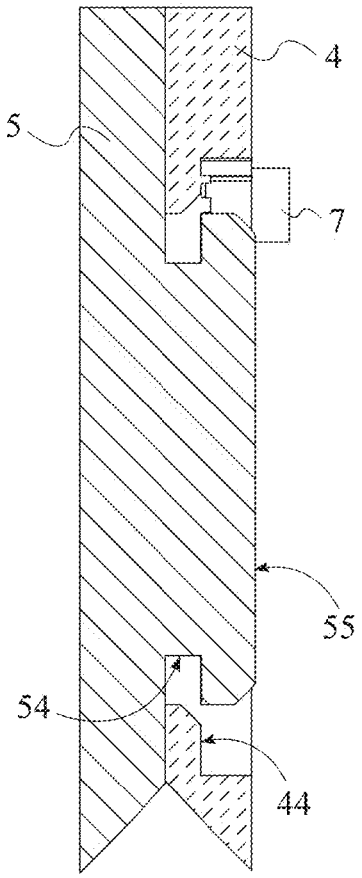
FIG. 7 is an enlarged, cross-sectional view taken along lines 7-7 in FIG. 6, showing the connector disengaged from the base receiver.
Figure 8:
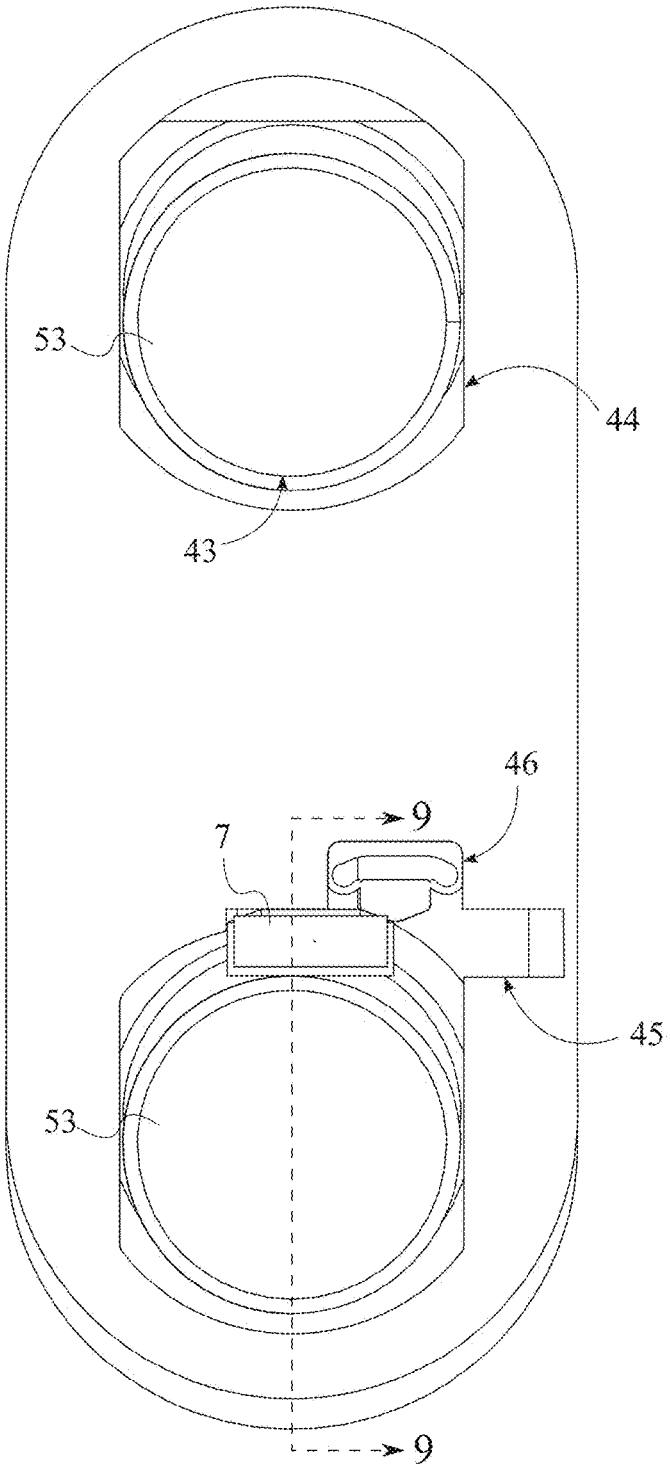
FIG. 8 is a front elevational view of the attachment mechanism of the present invention, shown in a locked position.
Figure 9:
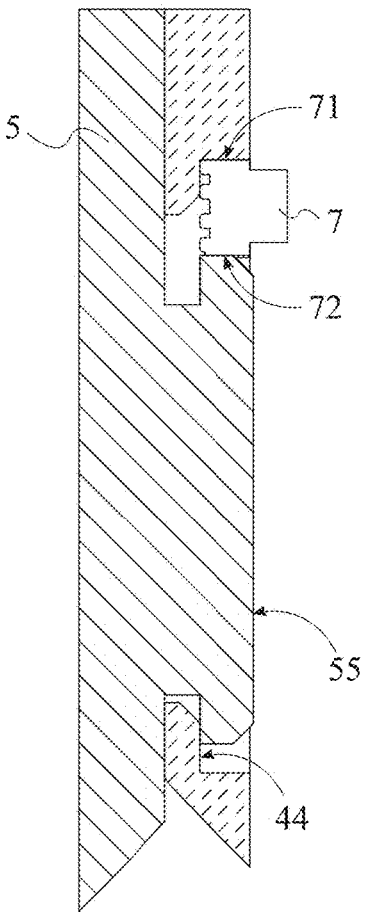
FIG. 9 is an enlarged, cross-sectional view taken along lines 9-9 in FIG. 8, showing the connector engaged with the base receiver.

In reference to FIGS. 6-9, the base receiver 4 and the attachment adapter 5 are configured to connect and interlock with one another. To activate the attachment mechanism 3, the user first aligns each of the connectors 53 of the attachment adapter 5 with each of the corresponding receiver openings 43 of the base receiver 4. As seen in FIGS. 6-7, the user then inserts the connectors 53 into the receiver openings 43, thereby joining the attachment adapter 5 to the base receiver 4 in an unlocked position. As seen in FIGS. 8-9, to lock the connectors 53 in place, the user then slides the connectors 53 vertically along a slotted path integrated into the base receiver 4. Once locked in place, the attachment adapter 5 is now operably coupled to the base receiver 4 and the object or accessory is safely secured to the base 2. To disengage and remove the attachment from the base 2, the user simply follows the same steps in reverse. Specifically, the user slides the connectors 53 into the unlocked position by aligning the connectors 53 with the receiver openings 43. Once aligned, the user can then safely detach the attachment adapter 5 from the base receiver 4, which effectively removes the object or accessory from the base 2.

The base receiver 4 is an elongated body comprising a front face 41, a rear face 42, at least one receiver opening 43, and at least one recessed slot 44. As seen in FIG. 6, the at least one receiver opening 43 is disposed on the rear face 42, traversing through the front face 41. The shape and size of the at least one receiver opening 43 is defined by the shape and size of the at least one connector 53 on the attachment adapter 5. Preferably, the receiver opening 43 is circular in shape. However, the shape of the receiver opening 43 is not limited and can take the form of any suitable shape based on design, user, and or manufacturing requirements.

For proper engagement between the connector 53 and the base receiver 4, the at least one recessed slot 44 is disposed on the front face 41 of the base receiver 4 and in communication with the at least one receiver opening 43. As seen in FIG. 6, the width of the recessed slot 44 is defined by the width of the receiver opening 43. Moreover, each of the recessed slots 44 traverse longitudinally (i.e., vertically) from each of the corresponding receiver openings 43 to a predefined distance. In this arrangement, the at least one recessed slot 44 forms a slotted pathway for the corresponding connector 53, allowing restricted path of travel of the connector 53 along the vertical direction only. This arrangement allows the connector 53 to slide into and out of the locked position, as illustrated in FIG. 7 and FIG. 9.

The attachment adapter 5 is an elongated body comprising a front face 51, a rear face 52, and at least one connector 53. The at least one connector 53 is disposed on the front face 51, extending outward. The position and shape of each of the at least one connector 53 is defined by the position and shape of each of the at least one receiver opening 43. Thus, the at least one connector 53 is capable of being fully inserted into the at least one receiver opening 43, thereby joining the base receiver 4 to the attachment adapter 5 in the unlocked position.

To lock the attachment adapter 5 to the base receiver 4, each of the at least one connector 53 further comprises a neck 54 and a flanged head 55. As best seen in FIG. 7, the neck 54 extends outward from the front face 51 of the attachment adapter 5, and the flanged head 55 is terminally connected to a distal end of the neck 54. Moreover, the flanged head 55 is larger diameter-wise than the neck 54. In this arrangement, the backside of the flanged head 55 is configured to slidably engage with the recessed slot 44 of the base receiver 4. The user can slide the connectors 53 vertically into a locked position, thereby securing the attachment adapter 5 to the base receiver 4. The connectors 53 are effectively locked in place due to the misalignment between the connector 53 and the receiver opening 43.

In the preferred embodiment, the attachment mechanism 3 further comprises a spring-loaded lock 6 designed to secure and hold the attachment to the base 2 when activated. As seen in FIGS. 4-5, the spring-loaded lock 6 is integrated into the base receiver 4. When activated, the spring-loaded lock 6 holds the attachment adapter 5 to the base receiver 4 in the locked position. When deactivated, the spring-loaded lock 6 quickly releases the attachment adapter 5 from the locked position, allowing the user to detach the attachment adapter 5 from the base receiver 4.

The spring-loaded lock 6 comprises a slide latch 7 and a spring 8. As best seen in FIG. 6, the slide latch 7 is preferably a rectangular-shaped body, configured to slide horizontally within a latch cavity 45 integrated into the base receiver 4. The latch cavity 45 is disposed on the front face 41 of the base receiver 4, wherein the latch cavity is in communication with any one of the receiver openings 43 and a corresponding recessed slot 44. Regarding position, the latch cavity 45 is positioned directly below the receiver opening 43 and oriented perpendicular to the recessed slot 44. Regarding size, the latch cavity 45 is substantially longer than the slide latch 7, allowing the slide latch 7 to move to and from the locked and unlocked positions. In this arrangement, the slide latch 7 slidably engages with latch cavity 45 and is operably connected to the connector 53.

The spring 8 is preferably a flexible body, comprising a flexible base 81 and a wedge-shaped protrusion 82. The spring 8 is positioned within a spring cavity 46 integrated into the base receiver 4. As best seen in FIG. 6, the spring cavity 46 is disposed on the front face 41 of the base receiver 4 and in communication with the latch cavity 45. Regarding position, the spring cavity 46 is positioned directly above and substantially centered with the latch cavity 45. The flexible base 81 of the spring 8 is mounted within the spring cavity 46, while a portion of the wedge-shaped protrusion 82 extends into the latch cavity 45. In this arrangement, the wedge-shaped protrusion 82 is operably connected to the top side 71 of the slide latch 7. Stated another way, the wedge-shaped protrusion 82 retracts inward into the spring cavity 46 as the slide latch 7 travels over and across the wedge-shaped protrusion 82. The spring 8 applies resistive pressure to the slide latch 7, requiring the user to forcibly move the slide latch 7 to and from the locked and unlocked positions. Thus, the spring 8 prevents the slide latch 7 from inadvertently moving into the locked or unlocked position when no force is applied.

To access the spring-loaded lock 6, the slide latch 7 is laterally integrated onto the front face 21 of the base 2. More specifically, as seen in FIG. 3, a latch opening 9 is disposed on the front face 21 of the base 2. The latch opening 9 is aligned with the latch cavity 45 of the base receiver 4, wherein a portion of the slide latch 7 protrudes outward and through the latch opening 9. This arrangement allows the user to selectively engage the spring-loaded lock 6 through the base 2.

To operate the spring-loaded lock 6, the slide latch 7 is first positioned away from the receiver opening 43, allowing for proper clearance to insert/remove the connector 53 to and from the receiver opening 43. To securely hold the connector 53 in the locked position, the slide latch 7 is moved across and into the receiver opening 43. Once fully traversed, the bottom side 72 of the slide latch 7 makes contact with the top of the connector 53, as seen in FIG. 9, thereby obstructing the pathway and keeping the connector 53 misaligned with the receiver opening 43. The misalignment between the connector 53 and receiver opening 43 keeps the connector 53 in the locked position until the spring-loaded lock 6 is disengaged.

What is claimed is:

1. An attachment fastening system comprising:
- a base;
- an attachment mechanism;
- the base being connected to the attachment mechanism;
- the attachment mechanism comprising a base receiver, an attachment adapter, and a spring-loaded lock;
- the base receiver comprising at least one receiver opening and at least one recessed slot;
- the recessed slot being disposed on a front face of the base receiver;
- the recessed slot being in communication with the receiver opening;
- the attachment adapter comprising at least one connector;
- the connector comprising a neck and a flanged head;
- the receiver opening being adapted to receive the connector;
- the flanged head being slidably engaged with the recessed slot;
- the connector being configured to slide into a locked position;
- the attachment adapter being operably coupled to the base receiver in the locked position;
- the spring-loaded lock being integrated into the base receiver;
- the spring-loaded lock comprising a slide latch and a spring;
- the spring being operably connected to the slide latch;
- the slide latch being operably connected to the connector;
- the spring-loaded lock capable of securing the connector in the locked position;
- a latch cavity being disposed on the front face of the base receiver;
- a spring cavity being disposed on the front face of the base receiver;
- the spring cavity being in communication with the latch cavity;
- the latch cavity being in communication with the recessed slot;
- the latch cavity being oriented perpendicular to the recessed slot;
- the slide latch being slidably engaged within the latch cavity; and
- the spring being positioned within the spring cavity.

2. The attachment fastening system as claimed in claim 1 comprising:
- the spring comprising a flexible base and a wedge-shaped protrusion;
- the flexible base being mounted within the spring cavity;
- the wedge-shaped protrusion extending into the latch cavity; and
- the wedge-shaped protrusion being operably connected to the top side of the slide latch.

3. The attachment fastening system as claimed in claim 1 comprising:
- a latch opening being disposed on a front face of the base;
- the latch opening being aligned with the latch cavity; and
- the slide latch being laterally integrated onto the front face of the base.

4. The attachment fastening system as claimed in claim 1 comprising:
- a plurality of straps;
- the base comprising a plurality of openings;
- the plurality of straps being attached to the plurality of openings;

the plurality of straps being arranged to form at least one closed loop; and the base capable of being worn as a backpack.

5. The attachment fastening system as claimed in claim 1, wherein the receiver opening is circular in shape.

6. The attachment fastening system as claimed in claim 5, wherein the recessed slot is oriented vertically.

7. An attachment fastening system comprising:

a base;

an attachment mechanism;

the base being connected to the attachment mechanism;

the attachment mechanism comprising a base receiver, an attachment adapter, and a spring-loaded lock;

the base receiver comprising at least one receiver opening and at least one recessed slot;

the recessed slot being disposed on a front face of the base receiver;

the recessed slot being in communication with the receiver opening;

the attachment adapter comprising at least one connector;

the connector comprising a neck and a flanged head;

the receiver opening being adapted to receive the connector;

the receiver opening being circular in shape;

the flanged head being slidably engaged with the recessed slot;

the connector being configured to slide into a locked position;

the attachment adapter being operably coupled to the base receiver in the locked position;

the spring-loaded lock being integrated into the base receiver;

the spring-loaded lock comprising a slide latch and a spring;

the spring being operably connected to the slide latch;

the slide latch being operably connected to the connector;

the spring-loaded lock capable of securing the connector in the locked position;

a latch cavity being disposed on the front face of the base receiver;

a spring cavity being disposed on the front face of the base receiver;

the spring cavity being in communication with the latch cavity;

the latch cavity being in communication with the recessed slot;

the latch cavity being oriented perpendicular to the recessed slot;

the slide latch being slidably engaged within the latch cavity; and the spring being positioned within the spring cavity.

8. The attachment fastening system as claimed in claim 7 comprising:

the spring comprising a flexible base and a wedge-shaped protrusion;

the flexible base being mounted within the spring cavity;

the wedge-shaped protrusion extending into the latch cavity; and the wedge-shaped protrusion being operably connected to the top side of the slide latch.

9. The attachment fastening system as claimed in claim 7 comprising:

a latch opening being disposed on a front face of the base;

the latch opening being aligned with the latch cavity; and the slide latch being laterally integrated onto the front face of the base.

10. The attachment fastening system as claimed in claim 7 comprising:

a plurality of straps;

the base comprising a plurality of openings;

the plurality of straps being attached to the plurality of openings;

the plurality of straps being arranged to form at least one closed loop; and the base capable of being worn as a backpack.

11. The attachment fastening system as claimed in claim 7, wherein the recessed slot is oriented vertically.

12. An attachment fastening system comprising:

a base;

an attachment mechanism;

a plurality of straps;

the base being connected to the attachment mechanism;

the base comprising a plurality of openings;

the plurality of straps being attached to the plurality of openings;

the plurality of straps being arranged to form at least one closed loop;

the base capable of being worn as a backpack;

the attachment mechanism comprising a base receiver, an attachment adapter, and a spring-loaded lock;

the base receiver comprising at least one receiver opening and at least one recessed slot;

the recessed slot being disposed on a front face of the base receiver;

the recessed slot being in communication with the receiver opening;

the attachment adapter comprising at least one connector;

the connector comprising a neck and a flanged head;

the receiver opening being adapted to receive the connector;

the flanged head being slidably engaged with the recessed slot;

the connector being configured to slide into a locked position;

the attachment adapter being operably coupled to the base receiver in the locked position;

the spring-loaded lock being integrated into the base receiver;

the spring-loaded lock comprising a slide latch and a spring;

the spring being operably connected to the slide latch;

the slide latch being operably connected to the connector;

the spring-loaded lock capable of securing the connector in the locked position;

a latch cavity being disposed on the front face of the base receiver;

a spring cavity being disposed on the front face of the base receiver;

the spring cavity being in communication with the latch cavity;

the latch cavity being in communication with the recessed slot;

the latch cavity being oriented perpendicular to the recessed slot;

the slide latch being slidably engaged within the latch cavity; and the spring being positioned within the spring cavity.

13. The attachment fastening system as claimed in claim 12 comprising:

the spring comprising a flexible base and a wedge-shaped protrusion;

the flexible base being mounted within the spring cavity;

the wedge-shaped protrusion extending into the latch cavity; and the wedge-shaped protrusion being operably connected to the top side of the slide latch.

14. The attachment fastening system as claimed in claim 12 comprising:

a latch opening being disposed on a front face of the base;

the latch opening being aligned with the latch cavity; and the slide latch being laterally integrated onto the front face of the base.

15. The attachment fastening system as claimed in claim 12, wherein the receiver opening is circular in shape.

16. The attachment fastening system as claimed in claim 15, wherein the recessed slot is oriented vertically.

* * * * *